US010099481B2

(12) United States Patent
Arimura et al.

(10) Patent No.: US 10,099,481 B2
(45) Date of Patent: Oct. 16, 2018

(54) INK FILL DEVICE, INK FILLING METHOD, INK CARTRIDGE MANUFACTURING METHOD AND INK CARTRIDGE

(71) Applicant: RISO KAGAKU CORPORATION, Tokyo (JP)

(72) Inventors: Eijiro Arimura, Ibaraki (JP); Toshimasa Hoshino, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/432,061

(22) Filed: Feb. 14, 2017

(65) Prior Publication Data

US 2017/0246873 A1 Aug. 31, 2017

(30) Foreign Application Priority Data

Feb. 29, 2016 (JP) ..... 2016-037509

(51) Int. Cl.
*B41J 2/175* (2006.01)

(52) U.S. Cl.
CPC ..... *B41J 2/17506* (2013.01); *B41J 2/17523* (2013.01)

(58) Field of Classification Search
CPC ..... B41J 2/17506; B41J 2/17523
See application file for complete search history.

(56) References Cited

U.S. PATENT DOCUMENTS

2005/0140753 A1* 6/2005 Tsukahara ..... B41J 2/175 347/85
2005/0275699 A1* 12/2005 Sasaki ..... B41J 2/17509 347/85

FOREIGN PATENT DOCUMENTS

| | | |
|---|---|---|
| JP | 2004-243530 | 9/2004 |
| JP | 2005-193571 | 7/2005 |
| JP | 2010-82994 | 4/2010 |
| JP | 2015-139952 | 8/2015 |

* cited by examiner

*Primary Examiner* — Bradley Thies
(74) *Attorney, Agent, or Firm* — Greenblum & Bernstein, P.L.C.

(57) ABSTRACT

A joint section of a fill device is coupled to a supply opening of an ink cartridge, and a pressing force section presses an inside plug of the ink cartridge into the supply opening, to press down the inside plug against a biasing unit and release an opening to connect an ink fill section with an ink container. A first pump is operated and fills ink to the inside of the ink container. After the filling, the joint section separates from the supply opening, and the inside plug seals the supply opening by the biasing unit. Ink is filled with no spilling, into the ink container having an ink supply section with valve, and the ink cartridge can be manufactured with good efficiency.

21 Claims, 10 Drawing Sheets

| PRESSURE | FILL SPEED | FILL TIME AT 1000 ml |
|---|---|---|
| KPa | ml/s | s |
| 3.0 | 3.0 | 333 |
| 5.5 | 4.4 | 230 |
| 6.5 | 5.9 | 170 |
| 11.0 | 10.2 | 98 |
| 16.0 | 13.1 | 77 |
| 27.0 | 15.6 | 64 |

INK FILL DEVICE, INK FILLING METHOD, INK CARTRIDGE MANUFACTURING METHOD AND INK CARTRIDGE

TECHNICAL FIELD

The present invention relates to an ink fill device and ink filling method that fills ink into an ink cartridge detachable from an inkjet printing device (or inkjet printer), and relates in particular to an ink fill device, ink filling method and the like capable of efficiently producing ink cartridge by filling ink with no worry of ink staining the cartridge and surrounding environment because of good resistance to ink spillage during filling of ink into the cartridge.

BACKGROUND OF ART

The inkjet printing device of the related art that prints a desired image onto paper serving as the print media (object for printing) utilizes an ink cartridge for an inkjet recording device (hereafter, simply "ink cartridge") that supplies ink into the ink head. This ink cartridge is a structure housed in a box-shaped outer package, and includes an ink supply section that extracts ink from an ink container storing ink.

The ink cartridge is preferably easy to attach and detach from the inkjet printing device, durable against vibrations during shipping as well as the dropping that occurs during shipping and the handling process, and also capable of low-cost manufacture. To meet these needs, the applicants propose an ink cartridge such as described in the following Patent Literature 1.

As schematically shown in FIG. 9, the ink cartridge 200 of the related art is a cuboid-shaped body detachable horizontally (direction for attaching/detaching) relative to the printing device, and containing an outer package 240 that is a long thin outer box, an engagement surface 220 that engages with the cartridge installation mechanism of the printing device formed at one end of the opening of the outer package 240, an ink supply section 230 that is mounted at the engagement surface 220 as the dispensing opening for ink, and an ink container 210 connecting to the ink supply section 230 and housed within the outer package 240. In FIG. 9, the ink container 210 is shown as a cuboid shape but in the drawing is merely an example that swells when filled with a specified quantity of ink.

In the step of manufacturing an ink cartridge with the above-described structure, the following procedure is performed particularly when filling a specified amount of ink into the ink container. First of all, as shown in FIG. 10, two sheets of cuboid shaped sheet material made of synthetic resin which is the material of the ink container 210 are stacked overlapping each other, and a connecting tube 250 having openings at both ends is installed in the center on that short side. The four sides of the sheet body are thermally fused while in that state, and a bag body connecting the inside and outside by way of that connecting tube 250 is configured. Oblique lines in FIG. 10 show the regions adhering due to thermal fusing. Next, the opening in the ink container 210 made by the connecting tube 250 is gripped in an erect state by a suitable unit, and ink injected internally into the internal part of the bag body from the connecting tube 250 to fill it by using an appropriate ink fill device. There is no particular need to apply pressure at this time. The opening of the connecting tube 250 is an appropriate width so that if ink is supplied, the ink is injected into the ink container 210 by the force of gravity and fills it. The supply of ink stops at the point where a specified amount of ink has been filled. An ink supply section 260 mounted a normally close on-off valve is then inserted into the connecting tube and is fixed so as to seal the ink in a liquid-tight state in the ink container 210. The ink container 210 filled with the specified amount of ink and capable of supplying ink to an outside section by way of the ink supply section 260 can therefore be configured in this way.

The synthetic resin sheet material that forms the ink container 210 is not necessarily always limited to two sheets and may be configured from more than that number of sheets but even in such cases, the effect is the same as the above-described two sheets of material in the point that the ink container 210 has the structure that the connecting tube 250 penetrates through a portion of the bag body of synthetic resin sheet material in a liquid-tight state.

Patent Literature 1: Japanese Unexamined Patent Application Publication No. 2010-82994

SUMMARY OF INVENTION

Technical Problem

The connecting tube 250 mounted in the ink container 210 of ink cartridge 200 has a wide opening as described above so that ink can be easily filled from the connecting tube 250 if the ink container 210 is in an erect position. This arrangement provides the advantage of employing the step of injecting ink into the ink container 210 from the wide opening of the connecting tube 250 prior to mounting the ink supply section 260 with internal on-off valve to the connecting tube 250, and afterwards attaching the ink supply section 260 to the connecting tube 250.

However, though the opening of the connecting tube 250 that fills the ink is wide which makes the flow rate of ink larger during filling of ink, and the ink filling can be completed in a short time, there is the concern that a timing error when stopping the ink injection accompanying the completion of filling may cause ink to spill from the opening of the connecting tube 250 and stain the outer side of the ink container 210 and peripheral equipment. Also, even if there is no ink spillage from the opening of the connecting tube 250, when the quantity of ink filled into the inside is larger than the specified ink quantity, ink in the ink container 210 might overflow outwards during insertion of the ink supply section 260 in the opening of the connecting tube 250 in the final step and possibly stain the outer side of the ink container 210.

In view of the aforementioned problems, an object of the present invention is therefore to provide an ink fill device and ink filling method that can efficiently perform manufacture of the ink cartridge by ink filling, with a cartridge resistant to ink spillage and no concern about ink staining the cartridge and the peripheral equipment during filling of ink into the ink cartridge which contains the ink container mounted the ink supply section with a valve.

Solution to Problem

According to a first aspect of the invention, the ink fill device for filling an ink cartridge with ink, the ink cartridge comprising:

an ink container for storing the ink, a supply opening for connecting an inner section and an outer section of the ink container, an inner plug for opening and closing the supply opening, and a biasing unit for applying force on the inner plug in a closing direction, the ink fill device comprising:

a pressing force section freely moving relative to the inner plug along a movement direction of the inner plug, and making the inner plug move relatively against the force of the biasing unit;

a joint section being outwardly inserted over the pressing force section, and coupling to the supply opening released by the pressing force section; and an ink fill section coupled to the joint section, said ink fill section filling ink into the ink container from the supply opening released by the pressing force section.

According to a second aspect of the invention, in the ink fill device in the first aspect, the ink cartridge includes a covering member mounted in the inner section of the ink container, said covering member covering the inner plug and also restricting the movement direction of the inner plug.

According to a third aspect of the invention, in the ink fill device described in the second aspect, the ink fill device includes a suction section that suctions the inner section of the ink container from the supply opening released by the pressing force section to be coupled to the joint section, said suction section suctioning out at least one of the air and ink inside the ink container.

According to a fourth aspect of the invention, in the ink fill device described in the third aspect, the ink fill device includes a selector valve for alternatively coupling the ink fill section and the suction section to the joint section.

According to a fifth aspect of the invention, the ink fill device for filling ink into an ink cartridge comprising:

an ink container for storing the ink;

a supply opening for connecting an inner section and an outer section of the ink container;

an inner plug containing a plug part for opening and closing the supply opening, and a shaft part extending from the plug part;

a biasing unit for applying force on the inner plug in a closing direction; and a covering member mounted in the inner section of the ink container, said covering member restricting a movement direction of the shaft part of the inner plug, also covering at least a portion of the shaft part so as to prevent contact with the ink container even in a state in which the plug part seals the supply opening and even in a state in which the plug part opens the supply opening, the ink fill device comprising:

a pressing force section freely moving relative to the inner plug along the movement direction of the inner plug, and making the inner plug move relatively against the force of the biasing unit; and a joint section being outwardly inserted over the pressing force section, and coupling to the supply opening released by the pressing force section.

According to a sixth aspect of the invention, in the ink fill device described in the fifth aspect, the ink fill device includes a suction section that suctions the inner section of the ink container from the supply opening coupled to the joint section released by the pressing force section, said suction section suctioning out at least one of the ink and air inside the ink container According to a seventh aspect of the invention, in the ink fill device described in the sixth aspect, the ink fill device comprising:

an ink fill section coupled to the joint section, said ink fill station filling ink into the ink container from the supply opening released by the pressing force section; and a selector valve for alternatively coupling the ink fill section and suction section to the joint section.

According to an eighth aspect of the invention, the ink filling method for an ink cartridge, the ink cartridge comprising:

an ink container for storing the ink;

a supply opening for connecting an inner section and an outer section of the ink container;

an inner plug for opening and closing the supply opening; and a biasing unit for applying a force on the inner plug in a closing direction, the ink filling method comprising:

a first step of opening the supply opening by pressing the inner plug to inside the ink container against the force of the biasing unit;

a second step of injecting ink from the supply opening that is opened; and a third step of releasing pressing force on the inner plug at a stage in which the ink within the ink container attains a specified quantity.

According to a ninth aspect of the invention, in the ink filling method according to the eighth aspect, the ink cartridge includes a covering member mounted in the inner section of the ink container, said covering member covering the inner plug and also restricting a movement direction of the inner plug.

According to a tenth aspect of the invention, the ink filling method for an ink cartridge, the ink cartridge comprising:

an ink container for storing the ink;

a supply opening for connecting an inner section and an outer section of the ink container;

an inner plug containing a plug part for opening and closing the supply opening, and a shaft part extending from the plug part;

a biasing unit for applying force on the inner plug in a closing direction; and a covering member mounted in the inner section of the ink container, said covering member restricting a movement direction of the shaft part of the inner plug, also covering at least a portion of the shaft part so as to prevent contact with the ink container even in a state in which the plug part seals the supply opening and even in a state in which the plug part releases the supply opening, the ink filling method comprising:

a first step of opening the supply opening by pressing the inner plug to inside the ink container against the force of the biasing unit;

a second step of injecting ink from the supply opening that is opened; and a third step of releasing pressing force on the inner plug at a stage in which the ink within the ink container attains a specified quantity.

According to an eleventh aspect of the invention, in the ink filling method described in ninth or tenth aspect, after completing the second step, the air inside the ink container is discharged to outside the ink container by pressing the ink container with the supply opening released.

According to a twelfth aspect of the invention, in the ink filling method described in the eleventh aspect, wherein after completing the second step, the air inside the ink container is discharged to outside the ink container by suctioning out a portion of the ink inside the ink container from the supply opening.

According to a thirteenth aspect of the invention, in the ink filling method described in the twelfth aspect, further comprising remaining ink treatment step of suctioning out the ink remaining in the inside of the ink container between the first step and the second step.

According to a fourteenth aspect of the invention, in the ink filling method described in the thirteenth aspect, the ink cartridge is placed so that the supply opening faces laterally.

According to a fifteenth aspect of the invention, in an ink cartridge manufacturing method for manufacturing an ink cartridge, the ink cartridge comprising:

an ink container for storing the ink;

a supply opening for connecting to an inner section and an outer section of the ink container;

an inner plug for opening and closing the supply opening; and a biasing unit for applying force on the inner plug in a closing direction, the ink cartridge manufacturing method comprising:

a first step of opening the supply opening by pressing the inner plug to inside the ink container against the force of the biasing unit;

a second step of injecting ink from the supply opening that is opened; and a third step of releasing pressing force on the inner plug at a stage in which the ink within the ink container attains a specified quantity.

According to a sixteenth aspect of the invention, the ink cartridge manufacturing method for manufacturing an ink cartridge, the ink cartridge comprising:

an ink container for storing the ink;

a supply opening for connecting an inner section and an outer section of the ink container;

an inner plug containing a plug part for opening and closing the supply opening, and a shaft part extending from the plug part;

a biasing unit for applying force on the inner plug in a closing direction; and a covering member mounted in the inner section of the ink container, said covering member restricting a movement direction of the shaft part of the inner plug, also covering at least a portion of the shaft part so as to prevent contact with the ink container even in a state in which the plug part seals the supply opening and even in a state in which the plug part releases the supply opening, the ink cartridge manufacturing method comprising:

a first step of opening the supply opening by pressing the inner plug to inside of the ink container against the force of the biasing unit;

a second step of injecting ink from the supply opening that is opened; and a third step of releasing pressing force on the inner plug at a stage in which the ink within the ink container attains a specified quantity.

According to a seventeenth aspect of the invention, the ink cartridge comprising:

an ink container for storing a newly filled ink, a supply opening for connecting an inner section and an outer section of the ink container, an inner plug containing a plug part for opening and closing the supply opening, and a shaft part extending from the plug part;

a biasing unit for applying force on the inner plug in a closing direction; and a covering member mounted in the inner section of the ink container, said covering member restricting a movement direction of the shaft part of the inner plug, also covering at least a portion of the shaft part so as to prevent contact with the ink container even in a state in which the plug part seals the supply opening and even in a state in which the plug part releases the supply opening.

Advantageous Effects of Invention

In the ink fill device according to the first aspect of the invention, the ink container can be coupled to the ink fill section by releasing the supply opening by coupling the joint section to the supply opening of the ink cartridge, moving a pressing force section relative to the supply opening along the movement direction of the inside plug of the ink cartridge, and relatively moving the inside plug against the biasing force of the biasing unit of the ink cartridge. Here, if the ink fill section is operated, ink can be reliably filled into the ink container by way of the joint section with no spilling of ink to outside sections. After filling the ink, if the supply opening of the ink cartridge and the joint section separate relative to one another, and the pressing force section releases the pressing force relative to the inside plug, the inside plug to which force is applied by the biasing measure definitely seals the supply opening. In this way, the manufacture of ink cartridges by ink filling can be reliably performed without spilling ink and with no ink stain damage to the cartridge and peripheral environment.

In the ink fill device according to the second aspect of the invention, in the ink supply section formed in the ink container of the ink cartridge for this ink fill device; a covering member is formed in a state constantly covering the shaft part of the inner plug regardless of whether is sliding movement at the time the ink cartridge is attached or detached so that the ends of the shaft part and the inner surface of the ink container will not make contact even if, for example, the amount of ink becomes smaller and the ink cartridge has deflated. In this way the covering member functions as a member to protect the ink container so that the unexpected occurrence of ink leakage due to damage or wear on the ink container that tends to occur in ink cartridges of the related art can be prevented.

In the ink fill device according to the third aspect of the invention, when ink is filled in the ink container in which ink still remains, the suction section suctions the remaining ink out from the ink container so that ink filling can be performed. Moreover, when there is air in the ink container during ink filling, this air can be suctioned outwards.

In the ink fill device according to the fourth aspect of the invention, ink filling can be performed with the ink cartridge in which the joint section connects to the ink filling section by switching the selector valve. Moreover if necessary, the suction section can be connected to the joint section to suction the inside of the ink container, and ink can be suctioned out from the ink container, and air within the ink container can also be suctioned out.

According to the fifth, sixth, and seventh aspects of the invention, the ink fill device can achieve the same effects as the ink fill device according to the first, second, third, and fourth aspects.

In the ink filling method according to the eighth aspect of the invention, the supply opening is opened by pressing the inner plug to inside the ink container against the force of the biasing unit in the first step; ink is injected from the supply opening that is opened in the second step; and at a stage when ink inside the ink container reaches a predetermined (specified) quantity, the pressure on the inside plug is released and the ink container can be promptly sealed in the third step. Therefore, the manufacture of ink cartridges by ink filling can be reliably performed without spilling ink and with no ink stain damage to the cartridge and peripheral environment.

In the ink filling method according to the ninth aspect of the invention, in the ink supply section formed in the ink container of the ink cartridge for this ink filling method, a covering member is formed in a state constantly covering the shaft part of the inner plug regardless of whether the shaft part slides or not when the ink cartridge is attached or detached so that the ends of the shaft part and the inner surface of the ink container will not make contact even if, for example, the amount of remaining ink becomes smaller and the ink cartridge has deflated. The covering member in this way functions as a member to protect the ink container so that the unexpected occurrence of ink leakage due to damage or wear on the ink container that tends to occur in ink cartridges of the related art can be prevented.

According to the tenth aspect of the invention, the ink filling method can achieve the same effects as the ink filling method according to the eighth and ninth aspects.

In the ink filling method according to the eleventh aspect of the invention, after ink is injected into the ink container from the supply opening that is opened in the second step, a pressing force on the ink container in a state with the supply opening released (opened) discharges air from inside the ink container to outside the ink container.

In the ink filling method according to the twelfth aspect of the invention, after ink is injected into the ink container from the supply opening that is opened in the second step, a portion of the ink inside the ink container is suctioned out from the supply opening so that the air inside the ink container is discharged to outside the ink container.

In the ink filling method according to the thirteenth aspect of the invention, in the ink filling step utilizing the ink fill device, the ink remaining inside of the ink container can be suctioned out by the suction section between the first step and the second step, so that there is no mixing of remaining ink and fill ink inside of the ink container.

In the ink filling method according to the fourteenth aspect of the invention, the ink cartridge is placed so that the supply opening faces horizontally (or laterally) and filling ink is performed, thus providing the advantage that even if ink is overflow from the supply opening in the ink filling step, little overflowing ink will adhere to the outer surface of the ink container, and there is little possibility of stain damage to the ink container.

According to the fifteenth and sixteenth aspects of the invention, the manufacturing device for the ink cartridge can achieve the same effects as the eighth and ninth aspects.

According to the seventeenth aspect of the invention, the ink cartridge can obtain the same effects as the eighth, ninth, and tenth aspects.

DESCRIPTION OF EMBODIMENTS

The embodiments of the present invention are described next in detail while referring to the accompanying drawings. The present invention is not limited to the embodiments and the range of the present invention encompasses all adaptations, working examples, and technological applications, and so on that are capable of being conceived and rendered by one skilled in the art based on these embodiments.

In the specifications of the present invention, when utilizing terms for up, down, left, right for showing directions and positions in the following descriptions rendered while referring to the appended drawings, these terms match the up, down, left, right as viewed by the user as specified in each drawing.

Also, in the present invention, the direction for horizontally attaching/detaching the ink cartridge 1 to the printing device 100 is "attaching/detaching direction A"; the direction for inserting and loading the ink cartridge 1 into the printing device 100 is "loading direction A1"; and the direction for withdrawing and removing the cartridge 1 from the printing device 100 is "removing direction A2."

The loading direction A1 is the same direction that the ink filled in the ink cartridge 1 flows out to the printing device 100 (hereafter, "ink outflow direction B"); the insertion direction during storage of the ink container 10 in an outer package 20 is the same direction as the removing direction A2.

[1. Printing Device Overall Structure]

Figure 1A:
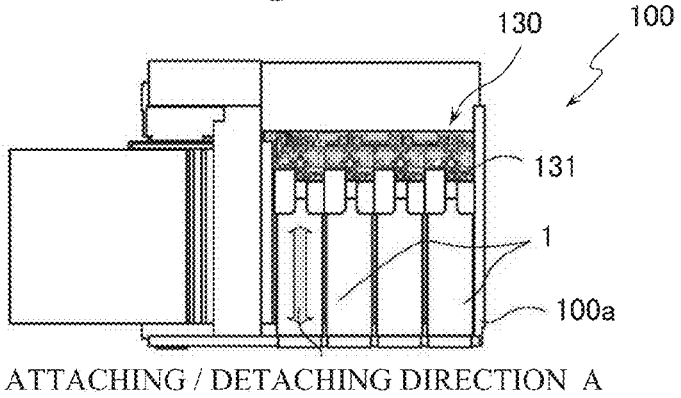
FIG. 1A is a schematic plan view showing the structure of the inkjet printing device for filling ink cartridges in the embodiment of the present invention.
Figure 1B:
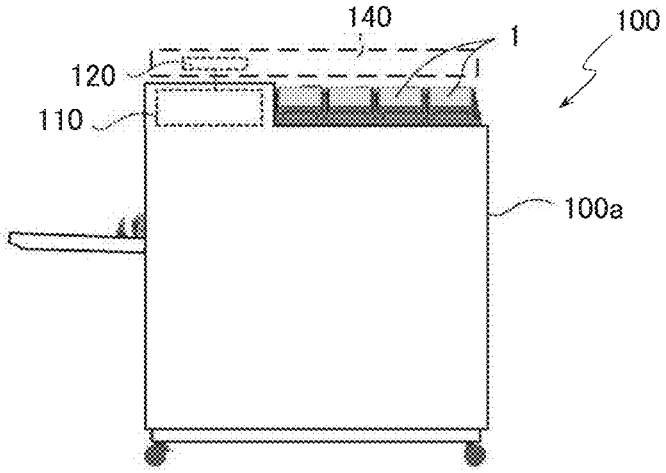
FIG. 1B is a schematic front view of the same device.
Figure 1C:
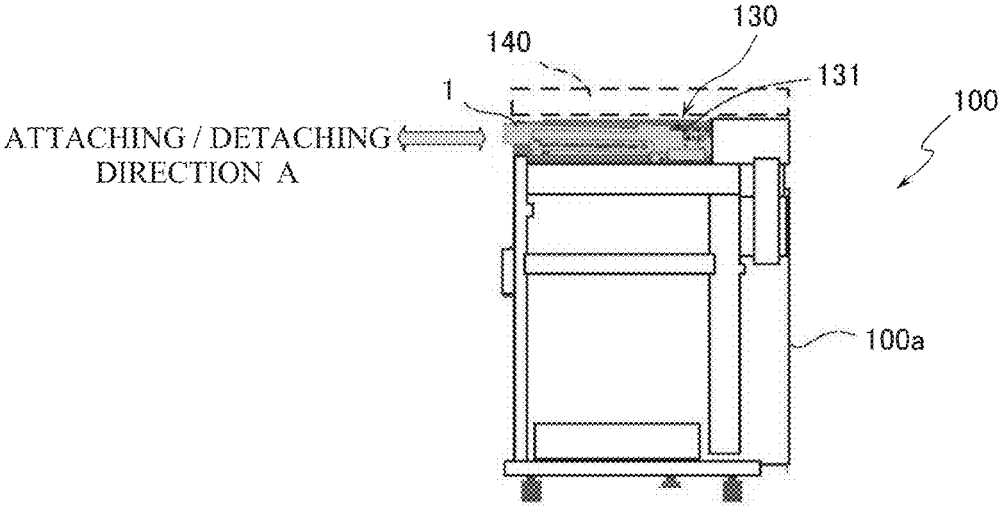
FIG. 1C is a schematic side view of the same device.

As shown in any of FIG. 1A through 1C, a printing device 100, in which the ink cartridge 1 of the present embodiment is loaded, includes plural ink heads in which many nozzles are formed, performs printing in line units dispensing ink of different colors from the respective heads, and forms plural images so as to mutually overlap on the printing medium (paper) conveyed by conveyor belt. Such an inkjet type line color printer as the printing device 100 will be explained as an example.

The present embodiment contains four ink head mounted in a line configuration, and form images by dispensing four colors of black (K), cyan (C), magenta (M), and yellow (Y)

from each of the ink heads. There are no particular restrictions on the number of ink heads and the type and number of colors of ink.

The printing device 100 contains a control unit 110 to execute the printing processing according to the printing job by controlling the overall operation of each unit that configures the device. Besides the above-described printing processing by the ink heads and the drive control of the conveyor mechanism, the control unit 110 also controls the supply of ink from the ink cartridge 1.

A setting operation unit 120 including, for example, entry devices such as operating keys and display/input panel is connected to the control unit 110, and the control unit 110 can receive instructions and setting operations by the user by way of the setting operation unit 120.

As shown in FIGS. 1A and 1C, at the upper section of the device body 100*a* in the printing device 100, plural cartridge connector sections 130 for connecting the ink cartridges 1 are mounted to each of the plural ink heads (a total of four to match the number of ink heads in the drawing).

An upper surface device 140 is mounted so as to cover the upper part of the cartridge connector sections 130. During loading, the ink cartridge 1 is inserted horizontally (loading direction A1) between the lower edge of this upper surface device 140 and the upper edge of the body of the printing device 100. An image reader device (scanner) for optically reading the documents conveyed by the ADF (auto document feeder) and the above-described setting operation unit 120 are for example mounted in the upper surface device 140.

Moreover, a holder section is mounted in the cartridge connector sections 130 to fit with the engagement part 30 described later during loading of the ink cartridge 1 into the printing device 100.

[2. Ink Cartridge Overall Structure]

The structure of the ink cartridge 1 of the present invention is described next.

Figure 2A:
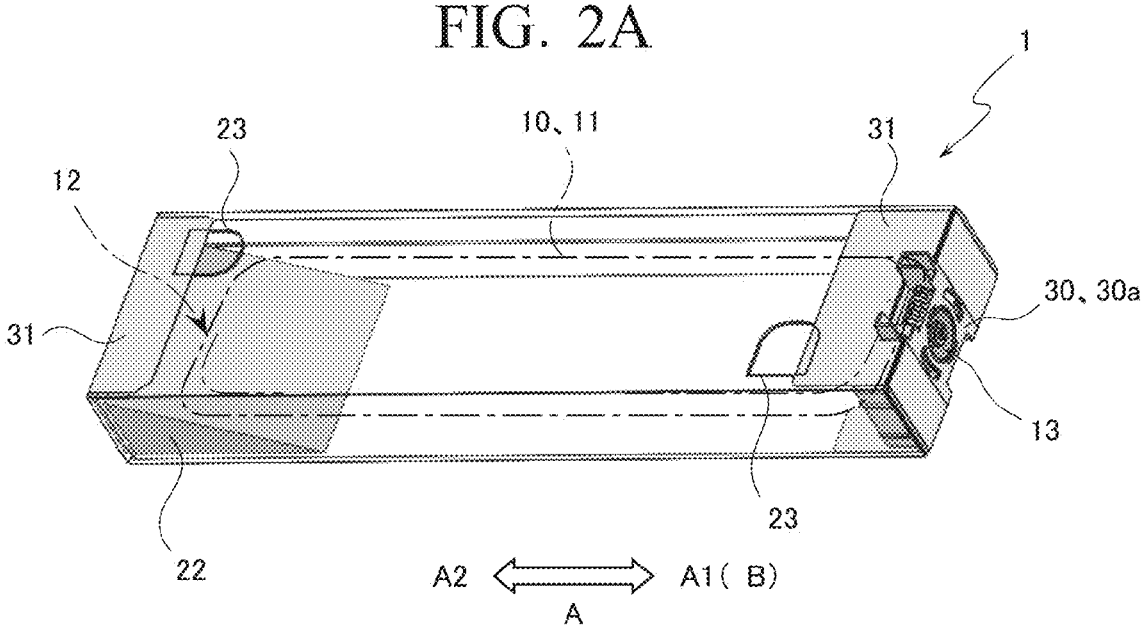
FIG. 2A is a schematic perspective view showing the internal section and an outer view as seen from the front side of the ink cartridge.
Figure 2B:
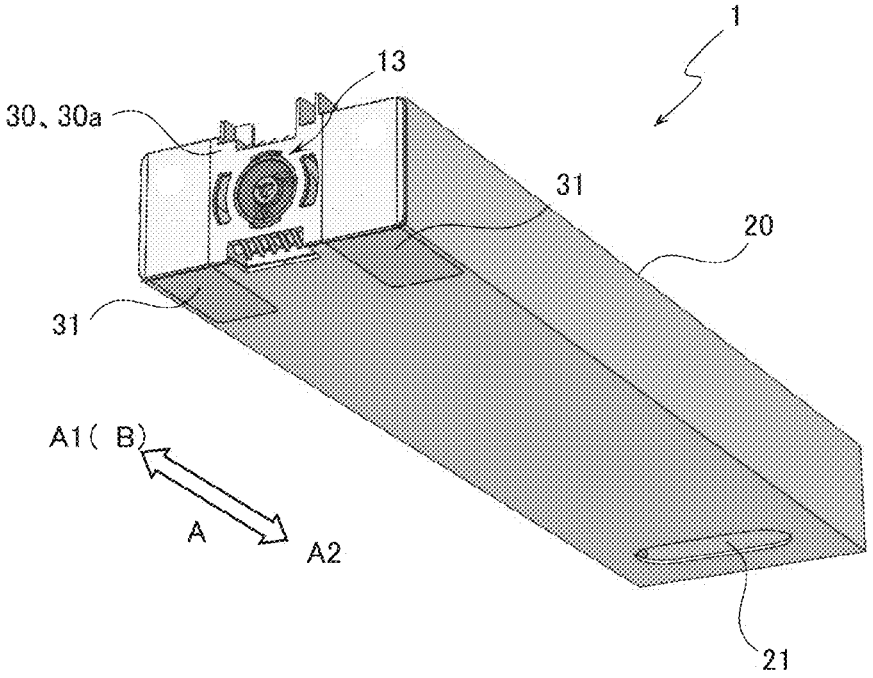
FIG. 2B is a schematic perspective view showing the external appearance of the same cartridge as seen from the rear side.

As shown in FIG. 2A or 2B, the ink cartridge 1 is a roughly cuboid-shaped narrow body attachable and detachable along the attaching/detaching direction A which is a horizontal direction relative to the printing device 100. The ink cartridge 1 includes an ink container 10 made from thermoplastic film material for filling the specified ink; an outer package 20 which is an outer box in which the ink container 10 is inserted; and the engagement part 30. The engagement part 30 is mounted on one end in the longitudinal direction of the ink container 10, and engages with a cartridge connector section 130 for the above-described printing device 100 or the cartridge connector section 130 of the ink fill device 300 described later.

<2-1. Ink Container>

The ink container 10 shown in FIG. 2 is a bag body in which the ink is sealed. Though described in detail later on, the ink container 10 of the present embodiment is formed by overlapping two sheets of rectangular (cuboid-shaped) thermoplastic film 11 in a state with the ink supply section 13 interposed between at one side in the longitudinal direction, and joining the edges by heat (thermal) fusing. The ink container 10 is inserted from the opening of the outer package 20. The engagement part 30 with the ink supply section 13 assembled therein is fit into the opening of the outer package 20. Thus, the ink cartridge 1 is configured.

The ink supply section 13 is given that name due to the supply of ink to the printing device 100 by way of this section during usage of the printing device 100. However, as described later on, if an ink cartridge 1 is connected to the cartridge connector sections 51 of the ink fill device 300, the ink can to the contrary be injected and filled into the ink container 10 by way of the ink supply section 13.

Figure 3:
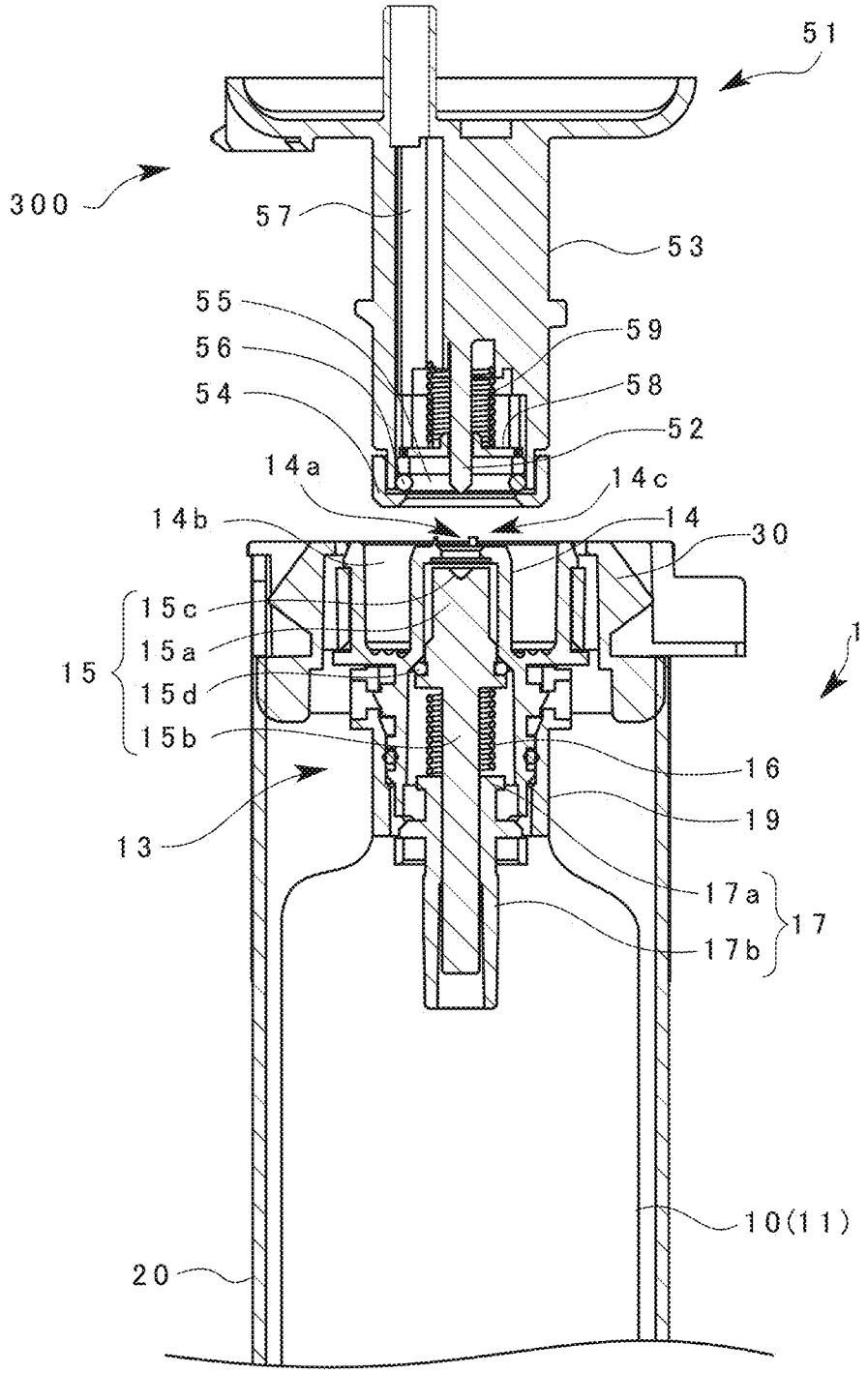
FIG. 3 is an enlarged cross-sectional view in the vicinity of the connection section of the same cartridge and the ink fill device of the embodiment before connection.

The ink supply section 13 for the ink cartridge 1 as shown in the lower part of FIG. 3, contains a supply opening 14 in which the opening 14*a* is formed to connect the inner section and the outside section of the ink container 10. A ring-shaped concave part 14*b* surrounding the opening 14*a* is formed on the front side of the supply opening 14. This concave part 14*b* is a structure for connecting each cartridge connecting section of the previously described printing device 100 and the ink fill device 300 described later on. An inner plug 15 for releasing or sealing the connection with the supply opening 14, a biasing unit 16 to close the supply opening 14 by urging the inner plug 15 in the ink outflow direction B, and a covering member 17 to guide the sliding of the inner plug 15 along the attaching direction A accompanying the attaching or detaching of the ink cartridge 1 are assembled into the supply opening 14.

The ink supply section 13 contains a connecting tube 19 integrated with the ink container 10 while being heat-sealed between the film 11 and film 11. The connecting tube 19 is a tubular-shaped member, and connects the inside and outside of the ink container 10.

The supply opening 14 and the ink container 10 are integrated into one piece by fitted in a liquid-tight state after inserting the supply opening 14 with inner plug 15 et cetera into the opening of the connecting tube 19 from the base edge of the supply opening 14. This type of structure is capable of effecting or interrupting the connection between the inner section and the outside section of the ink container 10 by opening or closing the opening 14*a* by way of the inner plug 15.

The structure of the inner plug 15 that opens and shuts the path in the ink supply section 13 is next described in detail.

The inside plug 15 contains a plug part 15*a* of which tip shuts the connection between the inner section and the outside section of the ink container 10 while directly contacting the opening 14*a* of supply opening 14; a shaft part 15*b* extending from the rear edge side (edge part on the side opposite the edge part of the side contacting the supply opening 14) of the plug part 15*a*; a latch receiver part 15*c* formed at the tip of the plug part 15*a* to engage with the cartridge connecting section of the printing device 100 or the cartridge connecting section of the ink fill device 300 described later; and an O ring 15*d* fits into the periphery of the plug part 15*a* to fill the gap between the supply opening 14 and the plug part 15*a* when the opening 14*a* is closed.

In the inner plug 15 having this type of structure, the tip side surface on the plug part 15*a* contacts the opening 14*a* of supply opening 14 to close the supply opening 14 by way of the bias force of the biasing unit 16. Also the O ring 15*d* fills the gap between the supply opening 14 and the plug part 15*a*. The connection between the inner section and the outside section of the ink container 10 is in this way shut and the ink does not flow outwards.

The biasing unit 16 that applies force on the inner plug 15 in the shutting direction, is configured from elastic pieces such as springs and rubber, and applies a force in the direction to shut the opening 14*a* of the supply opening 14 (or namely the fill direction A1) from the rear end side of plug part 15*a*. A spring is utilized as the biasing unit 16 in the present embodiment.

The covering member 17 that covers the shaft part 15*b* of the sliding inner plug 15 contains a support part 17*a* to support the biasing unit 16 at the tip, and a roughly tubular-shaped covering part 17*b* extending from the support part section 17*a*. Along with supporting the biasing unit 16 by the support part 17*a* of the covering member 17, the length of the covering member 17 is set so that all of the shaft part 15*b* of the inner plug 15 exposed from the supply opening 14 are covered. In other words, the shaft part 15*b* of the inner plug 15 is covered and hidden by the covering member 17 even in a state in which the plug part 15*a* shuts the supply opening 14 as shown in FIG. 3, and even in a state in which the plug part 15*a* is pressed in by external force and the supply opening 14 is released as shown in FIG. 5.

In this way, the length of the covering member 17*b* is set to an extent sufficient to cover all of the shaft part 15*b* exposed from the supply opening 14 regardless of whether or not the inner plug 15 slides so that, for example, even if the remaining ink has decreased to a low level and the ink container 10 has deflated, there will be no contact with the inner surface of the ink container 10 and the end section of the shaft part 15*b*. The hazard of the inner plug 15 damaging the ink container 10 is in this way eliminated so that the ink cartridge 1 can be utilized without having the user take precautions during handling.

Figure 5:
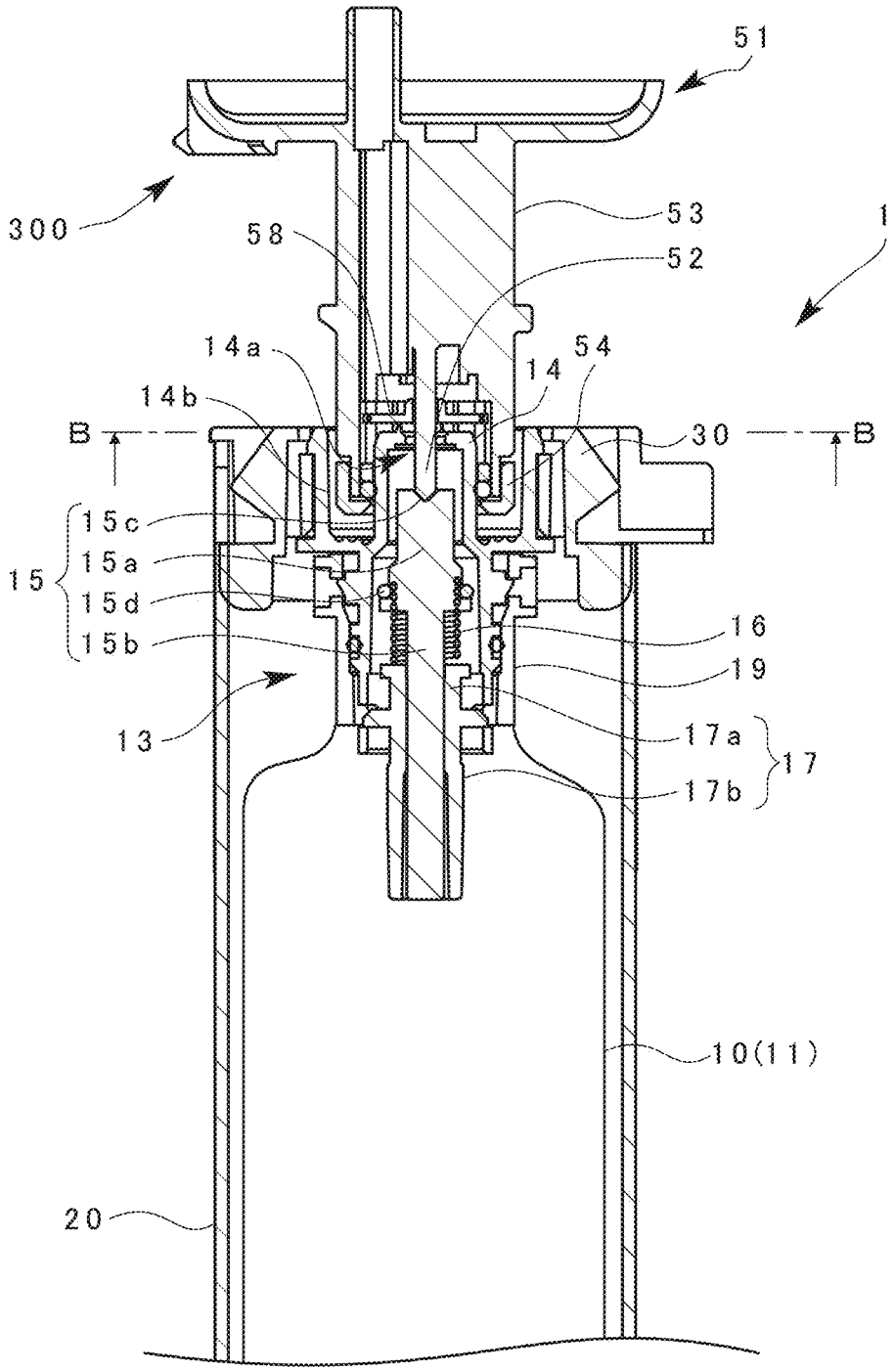
FIG. 5 is an enlarged cross-sectional view in the vicinity of the connection section of the same cartridge and the same ink fill device after connection.

Also as shown in FIG. 3 and FIG. 5, the upper half of the covering part 17*b* is set to be an inner diameter (guide inner diameter) to narrow the gap with the shaft part 15*b* as much as possible across a specified length. The shaft part 15*b* can in this way slide at a correct position along the attaching/detaching direction A when attaching or detaching the ink cartridge 1. Moreover, the lower half of the covering part 17*b* can be set to an inner diameter having a wider gap with the shaft part 15*b*.

Machining the guide inner diameter requires high precision causing the problem of a higher manufacturing cost; however, in the embodiment of the present invention, the sections of the covering part 17*b* not requiring a guide inner diameter can be a specified diameter larger than the guide inner diameter, so that manufacturing costs can be kept low since sections not requiring a guide inner diameter need not be subjected to unnecessary processing.

In the ink cartridge 1 of the present embodiment having the above-described structure, as shown in FIG. 3, the plug part 15*a* is press-forced towards the opening 14*a* by the force of the biasing unit 16 prior to loading the ink cartridge 1 into the printing device 100 or the ink fill device 300 so that along with blocking the opening 14*a*, the O ring 15*d* fills the gap between the plug part 15*a* and the supply opening 14, forming a state in which the supply opening 14 is sealed and ink cannot pass through.

Conversely to the above description, though the details are described later on, as shown in FIG. 5, when the inner plug 15 receives a pressing force in a direction opposite to the force of the biasing unit 16 and slides accordingly into the ink container 10, the opening 14*a* is released and connects the inner section of the ink container 10 with the outside section. If the ink cartridge 1 is loaded in the printing device 100 at this time, the ink can be supplied from the ink cartridge 1 to the printing device 100 along the ink outflow direction B. Also, if the ink cartridge 1 is loaded in the ink fill device 300 at this time, ink can be filled inside the ink container 10 of the ink cartridge 1.

As shown in FIG. 3, at the tip of the supply opening 14, a protruding part 14*c* is formed. The protruding part 14*c* forms a small gap between the opening 14*a* and the connection section of the printing device 100 or the ink fill device 300 when the ink cartridge 1 is loaded into the printing device 100 or the ink fill device 300, thereby setting the inflow quantity or outflow quantity of ink to an appropriate fixed quantity. In the present embodiment, three protruding parts 14*c* are formed at roughly equivalent angle intervals in the periphery of the opening 14*a*.

<2-2. Outer Package>

As shown in FIG. 2, the outer package 20 is assembled in a box shape forming a bottomed hollow cuboid shape by bending the folds set in the paper (for example cardboard) sheet member and pasting the adhesive margin sections together, with one end open in the longitudinal direction and sealing the other end.

An engagement part 30 is fit into the opening (the opening of the ink fill device 300 side or the printing device 100 side during loading of the cartridge) of the outer package 20. The engagement part 30 has an abutting surface as the connection section with the printing device 100 or the ink fill device 300, and latches in the cartridge connector sections 130 on the printing device 100 or the ink fill device 300.

A concave section 21 for drawing outward is formed at the lower surface of the outer package 20 to pass through the surface of the outer package 20 as shown in FIG. 2B. This concave section 21 is formed by making a specified notch in the concavity forming location of the outer package 20, and bending the notched sections to the inner surface side and also bending towards the end side of the outer package 20.

As shown in FIG. 2A, on the inner section end of the outer package 20, a partition member 22 is positioned to attain a shape of the internal space between the inner surface of the outer package 20 and the protruding outer surface of the end section 12 of the ink container 10. This arrangement allows the user to grasp the concave section 21 at the end of the outer package 20 and pull out the ink cartridge when attaching or detaching the ink cartridge, making attaching and detaching the cartridge 1 easier and improving the operability. Moreover, the user's hand does not directly touch the ink container 10 during attaching and detaching of the ink cartridge 1 so that damage to the ink container 10 is prevented.

As shown in FIG. 2A, a label 31 is attached at both ends in longitudinal direction of the outer package 20. The label 31 supports the overall box shape of the outer package 20 by reinforcing the both ends. A label peeling notch 23 is formed so as to overlap the edges of the label 31 on the upper side of the outer package 20. A portion of the notch 23 forms a fold section, the other sections form a breakage section, if the user presses with fingers on the notch 23 to the inner side of the outer package 20, and grasps the ruptured section and pulls the label 31 from the outer package 20, the label 31 can be peeled away with a ruptured portion from the outer package 20 so that the sorting operation for the label 31 and the outer package 20 can easily be performed.

<2-3. Engagement Part>

The engagement part 30 is formed from hard material such as resin or metal, and functions as an attaching and detaching mechanism engaging with the connection section when loading the ink cartridge into the printing device 100 or the ink fill device 300.

As shown in FIGS. 2A and 2B, after the engagement part 30 is fit into the opening section of the outer package 20, the engagement part is attached and secured in place by the seal-shaped label 31 (sheet item coated with adhesive on the rear side of synthetic paper having synthetic resin as the main ingredient such as film method synthetic paper) having adhesive on the rear side. This label 31 holds the engagement part 30 fit in the outer package 20 while being wound from one side to the other side of the outer package 20 by way of the abutting surface 30*a* of the engagement part 30 in a state in which the engagement part 30 is fit into the outer package 20.

[3. Ink Fill Device 300 Overall Structure]

When the ink container 10 is empty or when there is a surplus in the quantity of the ink container 10, the ink can be filled into the ink cartridge 1 by utilizing the ink fill device 300 described in the following.

The ink fill device 300 is described next while referring to FIG. 3 through FIG. 5.

Figure 4:
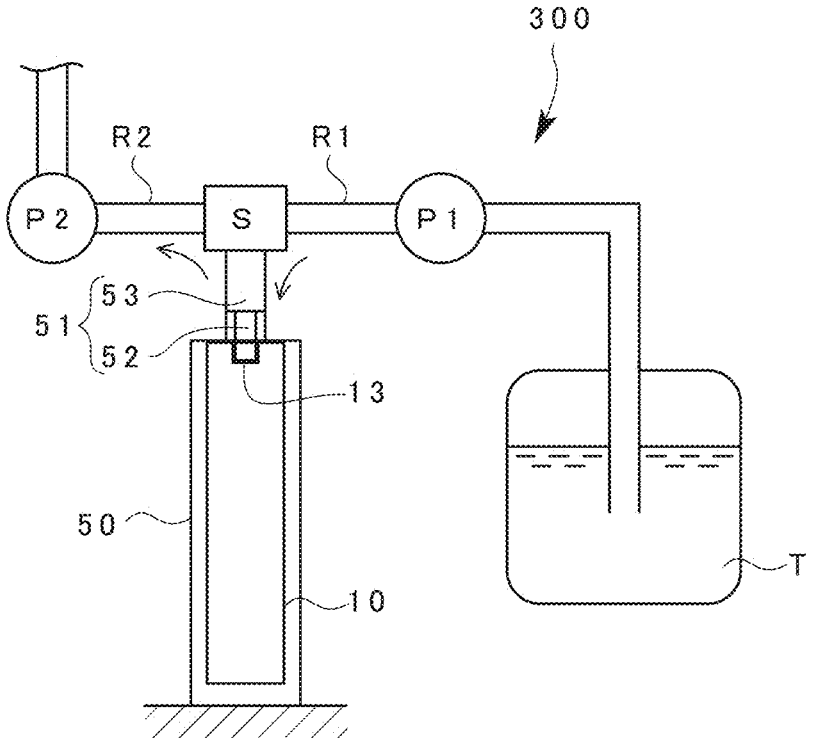
FIG. 4 is a diagrammatic structural view showing an overview of the same ink fill device connecting to the same ink cartridge.

The ink fill device 300 as shown in FIG. 4 contains a mounting unit 50 for installing the ink container 10 of the ink cartridge 1. The mounting unit 50 can mount the ink container 10 in a vertical position with the ink supply unit 13 set upwards, while being engaged with the engagement part 30 to hung the ink container 10 downwards. A cartridge connector unit 51 is set above the mounting unit 50 as a holder unit to connect and hold the ink container 10. This cartridge connector unit 51 contains a pressing force section 52 to press the inner plug 15 of the ink container 10 to release the opening 14*a*, and a joint section 53 that is outwardly inserted over the pressing force section 52, and is connected to the supply opening 14 of the ink container 10 released by the pressing force section 52.

The joint section 53 is connected to the selector valve S as shown in FIG. 4. A first pump P1 serving as the ink fill section, and an ink tank T holding accumulated fill ink are connected to a first selector path R1 of the selector valve S. The intake side of the first pump P1 is connected to the ink tank T; and the dispensing side is connected to the selector valve S. If the selector valve S is switched to the first selector path R1 side, and the first pump P1 is operated, the ink inside the ink container 10 can be injected to and filled with the ink container 10 by way of the joint section 53.

A shown in FIG. 4, a second selector path R2 of the selector valve S is connected to a suction opening of a second pump P2 serving as the suction section that suctions the inside of the ink container 10. Though not shown in the drawing, a dispensing opening of the second pump P2 is situated at a discharge outlet for suctioned air or a waste container for dispensed ink. Selective switching to one of the air discharge outlet and the waste container for ink is possible and if necessary may be installed for just one of the discharge outlet and the waste container.

The previously described cartridge connector unit 51 of the ink fill device 300 is described in detail while referring to FIG. 3, etc.

The cartridge connector unit 51 is mounted above the ink supply section 13 of the ink container 10 held in an upright position. The cartridge connector unit 51 axially conform to and confront the ink supply section 13. The joint section 53 of the cartridge connector unit 51 is a member having an external columnar shape, and the lower section is formed with an annular shaped stud 54 as well as a concave section 55 formed inward the stud 54 so as to match the concave part 14*b* of supply opening 14 of ink container 10. An ink leakage stopper, an O ring 56 is mounted on the inner circumferential surface in the vicinity of the opening of the concave section 55. An ink flow path 57 passes through the concave section 55, and this ink flow path 57 connects to the selector valve S (see FIG. 4). The previously described rod-shaped pressing force section 52 is mounted facing downwards at the center of the concave section 55 of the joint section 53. The tip (downward end) of the pressing force section 52 is formed in a shape of a point to securely engage in the latch receiver part 15*c* of the inner plug 15. A support plate 58 in an outer ring shape for mating with concave part 55 is slidably and outwardly inserted over the pressing force section 52. A resilient member 59 such as a spring is interposed between the base section of the pressing force section 52 and the support plate 58.

The cartridge connector unit 51 of ink fill device 300 as shown in FIG. 3 and FIG. 5 is freely movable upwardly and downwardly relative to the ink container 10 along the movement direction of the inner plug 15 of the ink container 10. The cartridge connector unit 51 of ink fill device 300 and the ink container 10 just should be movable relative to one another. That is, the cartridge connector unit 51 of ink fill device 300 may be mounted at a specified position, and the mounting unit 50 with the ink container 10 may be installed movable up and down relative to the cartridge connector 51, and if necessary both of them may be movable. In any case, if the pressing force section 52 of ink fill container 300 moves the inner plug 15 of ink container 10 against the biasing force of the biasing unit 16, or if that pressing force is released and the biasing unit 16 moves the inner plug 15, the opening 14*a* of the supply opening 14 of the ink container 10 can be opened or closed.

{Ink Filling Step by the Ink Fill Device 300}

The method for filling ink into the ink container 10 of the ink cartridge 1 utilizing the ink fill device 300 is described while referring to FIG. 3 through FIG. 8. The filling step of this method is performed as a part of the manufacturing step of the ink cartridge 1.

An ink container 10 is installed in the mounting unit 50 of the ink fill container 300 as shown in FIG. 4, while being suspended below in an upright state with the ink supply section 13 situated above.

In the first step, as shown in FIG. 3 and FIG. 5, the cartridge connector unit 51 of ink fill device 300 is lowered. The annular shaped stud 54 of the joint section 53 engages (mates) with the concave part 14*b* of the supply opening 14 of ink container 10, and the tip (lower edge) of the pressing force section 52 engages the latch receiver part 15*c* of inner plug 15 and presses the inner plug 15*c* downward. Since there is the O ring 56 on the inner circumferential surface of the concave section 55 of the joint section 53 engaged with the inner plug 15, a definite ink leak stopping effect is obtained. The support plate 58 of the joint section 53 rises along the pressing force section 52 while compressing the resilient member 59 when the supply opening 14 engages with joint section 52. The support plate 58 contacts the supply opening 14 at a specified force while receiving the restorative force of the resilient member 59 in a state where the joint section 53 is engaged with the supply opening 14. Therefore, the engaging state is stable, in corporation with the sealing function of the O ring 56, to prevent ink leakage.

In the second step, ink is injected from the opening 14*a* of the opened supply opening 14. Namely, as shown in FIG. 4, the selector valve S switches to the first selector path R1 side and the first pump P1 is operated so that ink from the ink tank T can be filled by way of the joint section 53 into the inside of the ink container 10. An optional amount of ink can be injected, and can be filled until full, and may also be filled to reach only a portion of the actual capacity.

Figures 6A, 6B:
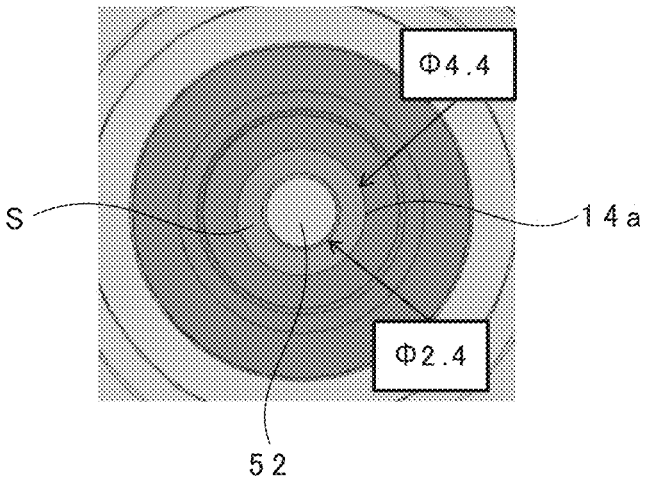
FIG. 6A is a table view showing test results from the ink fill operation for the same cartridge by the same ink fill device.
FIG. 6B is a cross-sectional view taken along lines B-B of FIG. 5.

FIG. 6A is a table showing a numerical example when actual ink filling is performed in the ink filling step of the second step. FIG. 6B is a cross sectional view taken along lines B-B of FIG. 5, showing the annular gap S which is the narrowest gap that the fill ink passes through. The capacity of the ink container 10 in this example is 1000 milliliters. The ink passes through the annular gap S between the opening 14*a* of the supply opening 14 and the pressing force section 52; however, as shown in FIG. 6B, the inner diameter of the opening 14*a* is 4.4 mm and the outer contour of the pressing force section 52 is 2.4 mm so that the surface area is $(4\cdot4^2-2\cdot4^2)\pi/4\approx10.68\ mm^2$. Also, the viscosity of the ink is approximately 10 mPa·s regardless of the color. When the pressure (kPa) on the dispensing side of the first pump P1 is changed while under these conditions, the ink fill speed (ml/s) and the fill time at 1000 milliliters (s) change as shown in the table in the figure.

Figure 7:
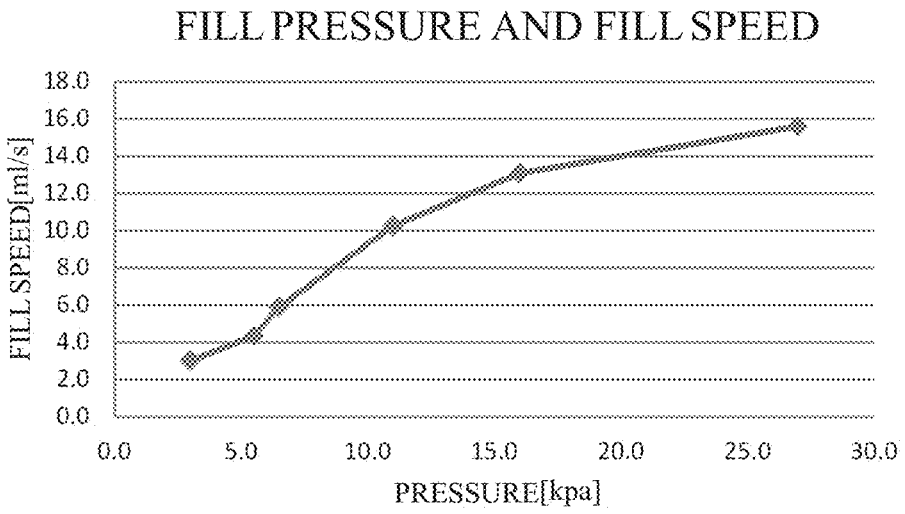
FIG. 7 is a graph showing the relation between the fill pressure and fill speed obtained the table in FIG. 6.
Figure 8:
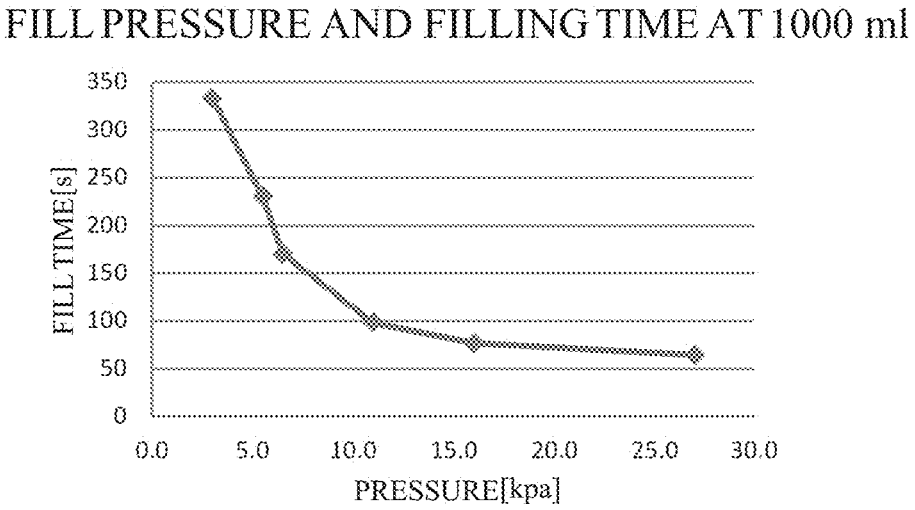
FIG. 8 is a graph showing the relation between the fill pressure and the filling time for 1000 milliliters obtained from the table in FIG. 6.
Figure 9:
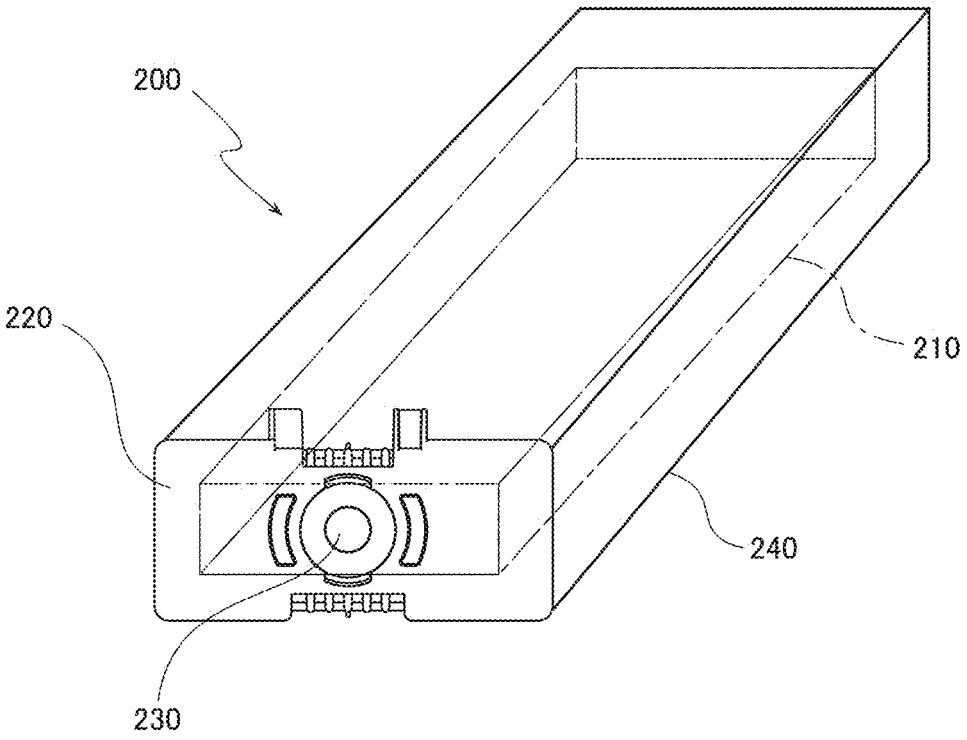
FIG. 9 is a schematic perspective view of the ink cartridge of the related art.
Figure 10:
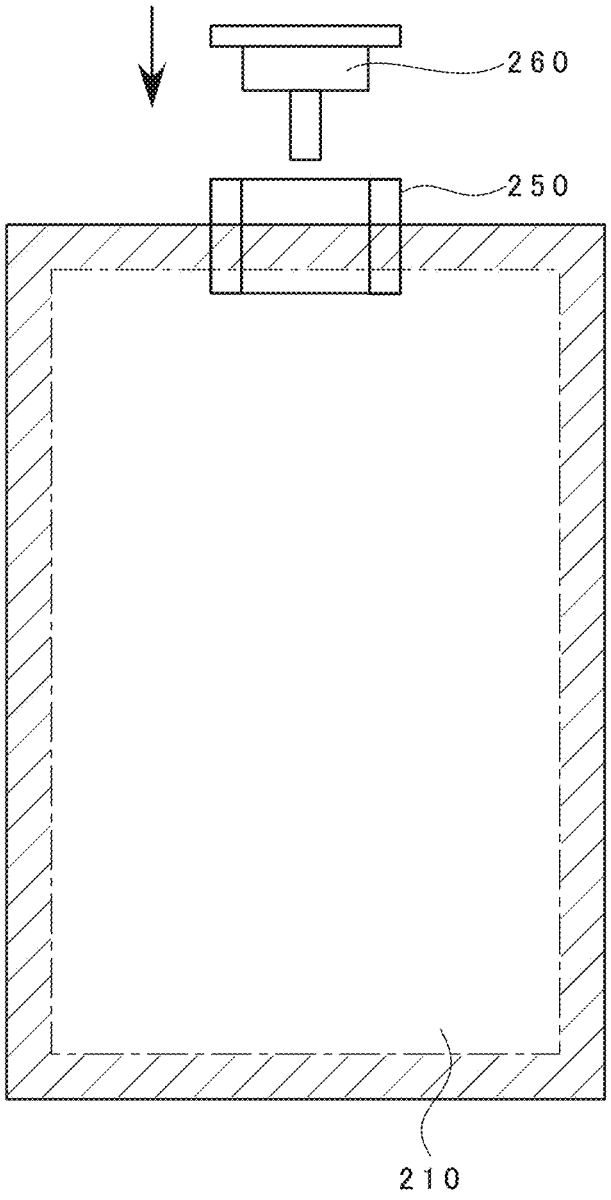
FIG. 10 is a schematic diagram showing the structure and manufacturing step of the ink container in the ink cartridge.

FIG. 7 is a graph showing the relation between the filling speed and the fill pressure obtained from the data shown in the table in FIG. 6. Examining this graph reveals that, the higher the dispensing pressure of the first pump P1, the greater the fill speed becomes. FIG. 8 is a graph showing the relation between the filling time at 1000 milliliters and the fill pressure obtained from the data shown in the table in FIG. 6. Examining this graph reveals that, the higher the dispensing pressure of the first pump P1, the shorter the filling time becomes. At a dispensing pressure of approximately 30 kPa, a 1000-milliliter ink container 10 will become full in about one minute. The data shown in the tables in FIG. 7 and FIG. 8 shows that even if the first pump P1 is set to a large dispensing pressure, the ink container 10 will be steadily filled with ink within no outstanding obstructions occurring.

In the third step, as shown in FIG. 5 and FIG. 3, at the proper timing at which the ink inside the ink container 10 reaches a specified quantity, the cartridge connector unit 51 of the ink fill device 300 rises, the pressing force on the inner plug 15 by the pressing force section 52 is released, the force of the biasing unit 16 moves the inner plug 15 upwards, and the ink container 10 is sealed by the inner plug 15.

Therefore, in the ink filling step, highly efficient and also reliable manufacture of the ink cartridges can be performed with high productivity as well as in a clean product state, with no ink spillage, and no damage to the outer surface of the ink container 10, the ink filling device 300 and periphery.

In the above-described ink filling step, air might penetrate inside the ink container 10 along with the filling of ink. Air might also already be inside the ink container 10 prior to the ink filling, and after filling, air might remain in the ink container 10. If air is present inside the ink container 10 of the ink cartridge 1, and printing is performed with that ink cartridge 1 loaded into the printing device 100, air might enter along the ink supply circuit of the printing device 100 and cause problems harmful to the printing to occur such as non-continuous supply of ink to the ink head or a malfunctioning ink supply. Therefore, the air is preferably bled (called air bleeding or deaeration) as much as possible from the inside of the ink container 10. In the present embodiment, a second pump P2 is installed in the ink filling device 300 as a suction section as previously described to serve as a unit for bleeding the air from the ink container 10.

Namely, when the second pump P2 is utilized as this suction section, the selector valve S switches to the second selector path R2 after injection of the required amount of ink inside the ink container 10 while still in a state where the supply opening 14 is released, and the second pump P2 operates. The air inside the ink container 10 passes through the selector valve S and is discharged outside by the second pump P2. The inside of the ink container 10 is filled with the required amount of ink, and in a state with hardly any air remaining so that the third step is executed here and the inner plug 15 seals the ink container 10.

This ink filling device 300 contains a second pump P2 serving as a suction section; however, if there is no suction section, the air can also be bled away manually. In other words, after completion of ink filling in the second step, if the user applies an appropriate pressure by hand from outside the ink container 10 with the opening 14*a* still maintained open (released) by the pressing force section 52, the air can be pressed out from the opening 14*a*, the pressing force section 52 later moved backwards, and the inner plug 15 seals the opening 14*a*.

The present embodiment in this way contains a suction section in the ink filling device 300 that bleeds away the air from inside the ink container 10, and when no suction section is provided, manually bleeds away the air. However, the air can also be bled away by other methods. For example, in the mounting unit 50 in the diagram in FIG. 4, it is shown that the box-shaped structure houses and supports the ink container 10, and it is possible that both the side walls of the structure are made to move freely by motive force, sandwich and press the ink container 10 from both sides, with the opening 14*a* released, and force the interior air outwards.

In the above-described ink filling step, when there is air inside the ink container 10 after filling the ink, the air is removed by a suction section; however, a suction section can be utilized to bleed the air by a different method. Namely, in the second step, a somewhat larger quantity of ink than required is filled inside the ink container 10, afterwards, the second pump P2 serving as the suction section suctions an appropriate quantity of ink with the opening 14*a* still left open, and when the required amount of ink in the ink container 10 is obtained, the third step is executed to seal the opening 14*a*. This method is capable of reliably bleeding the air along with the ink when suctioning surplus quantities of ink and bleeding them to outside the ink container 10.

In the above-described ink filling step, the step of filling ink into the empty ink container 10 is described as a portion of the manufacturing step of the ink cartridge 1. However, the ink fill device 300 can be utilized to remanufacture in-use or used ink containers 10, or remanufacture in-use or used ink cartridges 1 by filling just the required amount of ink into the used ink containers 10 or in-use ink containers 10.

In these cases, the ink container 10 can be regarded as storing no actual ink or storing ink that is less than a full amount. If the above-described first through third steps (including the step of removing air) are applied to refill these types of ink containers 10, the ink quantity in the ink containers 10 can be set to the required quantity. Moreover, the required quantity need not always be the full container quantity and may be half the quantity or one-third the quantity according to the user's request.

Moreover in those cases, between the first and second steps, the second pump P2 may be operated as the suction section to suction out the remaining ink from the ink container. Providing that this type of step is adopted, it can avoid mixture of ink remaining within the ink container 10 and ink to be newly filled within the ink tank T. This step is effective when the difference in quality between the ink remaining in the ink container 10 and the ink yet to be filled is too large to overlook.

The above-described ink filling device 300 and the ink filling method utilizing the ink filling device 300 performed the task with the ink inlet and outlet opening 14*a* set facing upward; however the ink container 10 can also be set horizontal. In other words, the mounting unit 50 of the filling device shown in FIG. 4 can be mounted in a state where that is rotated 90 degrees to the side in the drawing, and the ink container 10 engaged with the mounting unit 50 by the engagement part 30 can be set in a lateral position on a horizontal installation stand not shown in the drawing. The filling step utilizing this type of ink filling device 300 can supply ink so that the supply opening 14 faces horizontally and therefore offers the merit that even assuming that ink leaks out from the supply opening 14 in the ink filling step, the stain damage by ink to the ink container 10 will be minimal and there need be little concern about leaking ink adhering to the outer surface of the ink container 10.

DESCRIPTION OF REFERENCE SIGNS

1 . . . ink cartridge
10 . . . ink container
14 . . . supply opening (14*a* . . . opening, 14*b* . . . concave part, 14*c* . . . protruding part)
15 . . . inner plug (15*a* . . . plug part, 15*b* . . . shaft part, 15*c* . . . latch receiver part, 15*d* . . . O ring)
16 . . . biasing unit
17 . . . covering member (17*a* . . . support part, 17*b* . . . covering part)
20 . . . outer package
30 . . . engagement part (30*a* . . . abutting surface)
50 . . . mounting unit
51 . . . cartridge connector unit
52 . . . pressing force section
53 . . . joint section
S . . . selector valve
P1 . . . first pump serving as ink fill section
T . . . ink tank serving as ink fill section
P2 . . . second pump P2 serving as the suction section
100 . . . printing device
300 . . . ink fill device
A . . . attaching/detaching direction (A2 . . . loading direction, A2 . . . removing direction)
B . . . ink outflow direction

The invention claimed is:

1. An ink fill device for filling an ink cartridge with ink, the ink cartridge comprising:
an ink container for storing the ink;
a supply opening for connecting an inner section and an outer section of the ink container, the supply opening including an opening and a concave part surrounding the opening;
an inner plug for opening and closing the supply opening; and
a biasing unit for applying force on the inner plug in a closing direction,
the ink fill device comprising:
a pressing force section freely moving relative to the inner plug along a movement direction of the inner plug, and making the inner plug move relatively against the biasing force of the biasing unit;
a joint section being outwardly inserted over the pressing force section, and coupling to the supply opening released by the pressing force section, the joint section including a stud whose configuration matches the configuration of the concave part to permit mating therewith when the joint section is coupled to the supply opening; and
an ink fill section coupled to the joint section, said ink fill section filling ink into the ink container from the supply opening released by the pressing force section.

2. The ink fill device according to claim 1, wherein the ink cartridge includes a covering member mounted in the inner section of the ink container, said covering member covering the inner plug and also restricting the movement direction of the inner plug.

3. The ink fill device according to claim 2, wherein the ink fill device includes a suction section that suctions the inner section of the ink container from the supply opening released by the pressing force section to be coupled to the joint section, said suction section suctioning out at least one of the air and ink inside the ink container.

4. The ink fill device according to claim 3, wherein the ink fill device includes a selector valve for alternatively coupling the ink fill section and the suction section to the joint section.

5. An ink fill device for filling ink into an ink cartridge, the ink cartridge comprising:
an ink container for storing the ink;
a supply opening for connecting an inner section and an outer section of the ink container;
an inner plug containing a plug part for opening and closing the supply opening, and a shaft part extending inside the ink container from the plug part;
a biasing unit for applying force on the inner plug in a closing direction; and
a covering member extending inside the ink container, said covering member guiding a movement direction of the shaft part of the inner plug, also covering at least a portion of the shaft part extending inside the ink container so as to prevent contact with the ink container even in a state in which the plug part seals the supply opening and even in a state in which the plug part opens the supply opening,
the ink fill device comprising:
a pressing force section freely moving relative to the inner plug along the movement direction of the inner plug, and making the inner plug move relatively against the force of the biasing unit; and
a joint section being outwardly inserted over the pressing force section, and coupling to the supply opening released by the pressing force section.

6. The ink fill device according to claim 5, wherein the ink fill device includes a suction section that suctions the inner section of the ink container from the supply opening coupled to the joint section released by the pressing force section, said suction section suctioning out at least one of the ink and air inside the ink container.

7. The ink fill device according to claim 6, further comprising:
an ink fill section coupled to the joint section, said ink fill section filling ink into the ink container from the supply opening released by the pressing force section; and
a selector valve for alternatively coupling the ink fill section and suction section to the joint section.

8. An ink filling method for filling the ink cartridge recited in claim 1 with the ink fill device recited in claim 1, the ink filling method comprising:
opening the supply opening by pressing with a pressing force of the pressing force section the inner plug inside the ink container against the force of the biasing unit;
injecting ink with the ink fill section from the supply opening that is opened; and
releasing the pressing force on the inner plug at a stage in which the ink within the ink container attains a specified quantity.

9. The ink filling method according to claim 8, wherein the ink cartridge includes a covering member mounted in the inner section of the ink container, said covering member covering the inner plug and also restricting a movement direction of the inner plug.

10. The ink filling method according to claim 9, wherein after completing the injecting, the air inside the ink container is discharged to outside the ink container by pressing the ink container with the supply opening released.

11. The ink filling method according to claim 10, wherein after completing the injecting, the air inside the ink container is discharged to outside the ink container by suctioning out a portion of the ink inside the ink container from the supply opening.

12. The ink filling method according to claim 11, further comprising suctioning out the ink remaining in the inside of the ink container between the opening and the injecting operations.

13. The ink filling method according to claim 12, wherein the ink cartridge is placed so that the supply opening faces laterally.

14. An ink filling method for filling the ink cartridge recited in claim 5 with the ink fill device recited in claim 5, the ink filling method comprising:

opening the supply opening by pressing with a pressing force of the pressing force section the inner plug inside the ink container against the force of the biasing unit;

injecting ink from the supply opening that is opened; and releasing the pressing force on the inner plug at a stage in which the ink within the ink container attains a specified quantity.

15. The ink filling method according to claim 14, wherein after completing the injecting, the air inside the ink container is discharged to outside the ink container by pressing the ink container with the supply opening released.

16. The ink filling method according to claim 15, wherein after completing the injecting, the air inside the ink container is discharged to outside the ink container by suctioning out a portion of the ink inside the ink container from the supply opening.

17. The ink filling method according to claim 16, further comprising suctioning out the ink remaining in the inside of the ink container between the opening and injecting operations.

18. The ink filling method according to claim 17, wherein the ink cartridge is placed so that the supply opening faces laterally.

19. An ink cartridge manufacturing method for manufacturing the ink cartridge recited in claim 1 with the ink fill device recited in claim 1, the ink cartridge manufacturing method comprising:

opening the supply opening by pressing with a pressing force of the pressing force section the inner plug inside the ink container against the force of the biasing unit;

injecting with the ink fill section ink from the supply opening that is opened; and releasing the pressing force on the inner plug at a stage in which the ink within the ink container attains a specified quantity.

20. An ink cartridge manufacturing method for manufacturing the ink cartridge recited in claim 5 with the ink fill device recited in claim 5, the ink cartridge manufacturing method comprising:

opening the supply opening by pressing with a pressing force of the pressing force section the inner plug inside of the ink container against the force of the biasing unit;

injecting ink from the supply opening that is opened; and releasing the pressing force on the inner plug at a stage in which the ink within the ink container attains a specified quantity.

21. An ink cartridge comprising:

an ink container for storing a newly filled ink;

a supply opening for connecting an inner section and an outer section of the ink container;

an inner plug containing a plug part for opening and closing the supply opening, and a shaft part extending inside the ink container from the plug part;

a biasing unit for applying force on the inner plug in a closing direction; and a covering member extending inside of the ink container, said covering member guiding a movement direction of the shaft part of the inner plug, also covering at least a portion of the shaft part extending inside the ink container so as to prevent contact with the ink container even in a state in which the plug part seals the supply opening, even in a state in which the plug part releases the supply opening.

* * * * *